United States Patent [19]

Reever et al.

[11] 3,977,151

[45] Aug. 31, 1976

[54] MANUFACTURE OF AEROSOL PACKAGES BY UNDERCAP CHARGING WITH CARBON DIOXIDE PROPELLANT

[75] Inventors: Richard E. Reever, Streamwood; George F. Dasher, Inverness, both of Ill.

[73] Assignee: Alberto Culver Company, Melrose Park, Ill.

[22] Filed: Sept. 5, 1975

[21] Appl. No.: 610,575

[52] U.S. Cl. ..... 53/12; 53/22 R; 53/88; 53/112 R

[51] Int. Cl.[2] ..... B65B 31/00

[58] Field of Search ..... 53/12, 22 R, 88, 112 R

[56] References Cited

UNITED STATES PATENTS

| | | | |
|---|---|---|---|
| 2,684,806 | 7/1954 | McBean | 53/22 R |
| 3,545,162 | 12/1970 | Clapp | 53/22 R |

*Primary Examiner*—Travis S. McGehee

[57] ABSTRACT

Aerosol packages using carbon dioxide gas as the propellant can be manufactured on present commercial undercap filling machines by a method using a solvent for the liquid fill composed essentially of ethanol, restricting the liquid fill to 35 to 65% of the container volume, and charging the container with high pressure $CO_2$ gas (e.g., 500 to 800 psig) while limiting the lift of the cap unit to not over 0.23 inches, or less.

10 Claims, 5 Drawing Figures

MANUFACTURE OF AEROSOL PACKAGES BY UNDERCAP CHARGING WITH CARBON DIOXIDE PROPELLANT

BACKGROUND

Fluorocarbon propellants have been in common use for aerosol products, such as aerosol hair sprays, for many years. Since the propellant on release from the container forms a gas which enters the atmosphere, there have been increasing objections to the use of such propellants on the grounds of atmospheric pollution. Moreover, it has been recognized that carbon dioxide is a safe non-polluting propellant. Considerable research and development work has therefore been devoted to the substitution of carbon dioxide for the fluorocarbon propellants. Some success has been obtained with through-the-valve filling equipment. In this procedure, the liquid fill is introduced into the containers, the cap units are applied and crimped, and the $CO_2$ gas is charged through the valves of the attached cap units.

The foregoing procedure can be used with present commercial through-the-valve filling machines. However, the majority of aerosol filling machines in current commercial use are of the undercap-type. With these machines, the fluorocarbon propellant in liquid form is charged to the container with the cap assembly sitting loosely on top of the container. The liquid propellant flows into the container between the cap flange and the container sealing bead. Immediately following such propellant charging, the caps are crimped and sealed.

Heretofore, it has been believed that the undercap-type filling machines could not be used successfully for charging aerosol containers with carbon dioxide gas, except by a special auxilliary procedure in which a premix of the $CO_2$ propellant and the liquid fill is formed, and then filled as a liquid. This requires a system including a large gas-liquid impregnator unit, and other equipment for transferring the liquid premix to the containers.

From the standpoint of present commercial operations and equipment, what has been needed is a method which permits the standard undercap filling machines to be used in the same manner as they have been heretofore used, except that $CO_2$ as a gas is charged to the containers instead of the liquid fluorocarbon propellant. However, when this was tried with $CO_2$ gas at sufficiently high pressure to function effectively as a propellant many difficulties were encountered. When the can pressure did not reduce rapidly enough by the dissolving of the $CO_2$ gas in the liquid, the cans would rupture. Also, the crimping and sealing was erratic. Containers were improperly sealed because the cap was not fully seated on and crimped to the sealing bead. Where the cap was canted, on crimping, package rejects occured because of present or potential leakage. Such attempts were therefore discouraging.

As far as is known, the present invention for the first time provides a practical commercially feasible method for undercap filling or aerosol containers with carbon dioxide gas. The method can be carried out on standard undercap filling machines with only a minor modification, in the nature of an adjustment. Present users of undercap filling machines can therefore immediately and easily convert to use of $CO_2$ gas propellant, thereby eliminating the pollution hazard of fluorocarbon propellants.

THE DRAWINGS

It is first desired to identify the drawings, which will be referred to in connection with the following disclosure. The drawings comprise two sheets, including FIGS. 1, 2, 3, 3A, and 4.

DESCRIPTION OF INVENTION

Figure 1:
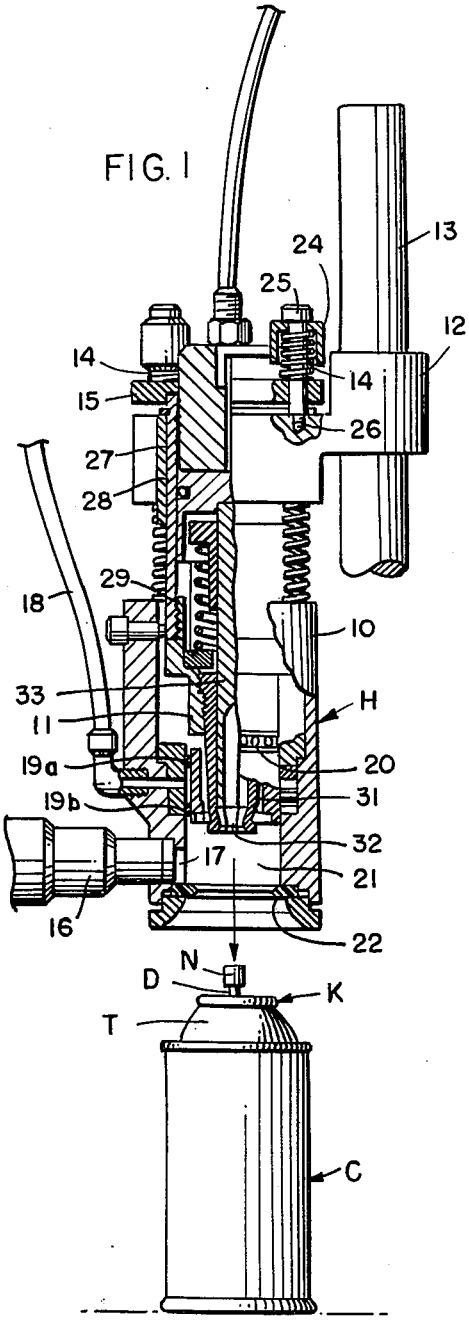
FIG. 1 is an elevational view, partly in section, of a portion of a standard undercap filling machine, a can being shown beneath the crimper head ready for gassing.

The method of this invention is particularly adapted for use with the undercap filling machines for aerosol containers manufactured by The Kartridg Pak Co., of Davenport, Iowa. Such machines are identified by the manufacturer as "K.P. Undercap Filling Machines". They are in widespread commercial use in the United States, and are described in operating manuals and other literature supplied by the manufacturer. In developing the method of this invention for use with undercap filling machines, it was discovered that the principal required modifications are in the filling method and not in the equipment. The method features of the invention will now be described.

In practicing the method, the solvent should be one in which carbon dioxide is highly soluble. Advantageously, the solvent which forms the liquid portion of the composition being filled can be ethanol containing a small percent of water. Ethanol alone could be used but usually a few percent of water will be present. In general, the ethanol solvent should not contain more than 15% water by volume and up to 10% water or less. The $CO_2$ solubility decreases rapidly with increasing water content. For example, ethanol-water mixtures containing from about 2 to 8% water are particularly advantageous.

It has also been found to be important to limit the liquid fill of the containers. The liquid composition prior to gassing can fill from about 35 to 65% of the internal volume of the container, leaving the rest of the can volume as an open head space above the liquid. It appears that the most advantageous liquid fill is in the range of about 40 to 60% of the internal can volume, such as, for example, a fill of 50%.

In the standard use of undercap filling machines, the liquid composition, consisting of the solvent and at least one active ingredient, is filled to the container. Then, with the cap assembly resting loosely on top of the container, the container is evacuated, nearly all of the air thereby being removed from the head space. Following the evacuation or vacuum stage of the operation of the machine, the liquid fluorocarbon propellant is charged to the container. Since it is supplied in a metered amount under pressure, the pressure of the liquid propellant causes the cap assembly to lift upwardly from the top of the container, thereby permitting the liquid propellant to flow into the container between the cap flange and the container bead, therefor the term "undercap" filling. The lifting of the cap off the container is permitted because the crimping head which contacts the container cap is biased downwardly by means of preload springs, which can compress to permit the crimping head and with the cap assembly pressing against it to move upwardly during the charging operation. Following the injection of the charge, the valve closes on the propellant inlet line, and the preload springs tend to restore the cap to a downward position in which it rests and contacts the sealing bead of the can.

In connection with the present invention, it was discovered that the amount of preloading must be increased by using stronger springs, thereby limiting the lift of the cap to a critical maximum. The lift can also be limited by an adjustment which lowers the crimping head. However, the required amount of the adjustment might cause deformation of the can domes, and is beyond the range of adjustment recommended by the manufacturer. This will be explained in more detail in connection with the accompanying drawings. In general, however, the total "lift" or separation of the cap during charging of the $CO_2$ gas should be not over 0.23 inches. When the lift was as great as 0.25 inches, filling and sealing difficulties began to be encountered. It therefore appears that the maximum amount of lift, which determines the space between the cap flange and the can bead, is an important feature of the method of the present invention. Best results appear to be obtained when the total lift is limited to not over 0.21 inches, or less. The optimum amount of total lift is believed to be in the range of about 0.15 to 0.20 inches. However, depending on the gas pressure employed, a lift of less than 0.15 inches can be employed, down to about 0.11 inches. Functionally, the lift should be sufficient to permit the gas to flow rapidly into the container, but because of the high pressure of the gas, only such small clearances are required.

The carbon dioxide gas is charged to the containers in metered amounts or "slugs". The gas should be supplied at high pressures. In general, pressures in the range of 500 to 800 psig are needed. One of the advantages of the method of this invention is that high $CO_2$ pressures can be used without causing rupture of the cans. For example, a desirable pressure for introducing the gas is from about 700 to 750 psig. More generally, pressures ranging from about 550 to 775 psig can be used.

Other steps of the method are performed in the standard conventional manner, such as the air evacuation prior to the $CO_2$ gassing, and the crimping of the cap unit to the container. However, certain details of these steps will be discussed in connection with the illustrations of the attached drawings.

Looking first at FIG. 1, there is shown the gassing and crimping head of a standard commercial under-the-cap filling machine; namely, the KP Undercap filling machine, as manufactured by The Kartridg Pak Co., of Davenport, Iowa. The head assembly, designated generally by the letter H includes an outer bell 10 and an inner bell 11, which are independently movable along a vertical axis in the sequence of operations required for evacuation, propellant charging, and crimping. The head assembly is supported on a mounting bracket 12, which is mounted on a post 13 that controls the vertical position of the head assembly. The head assembly also includes preload springs 14, which bear against a preload plate 15, and function in a manner which will be subsequently described. In the machine shown, springs 14 are arranged with a 90° spacing, and therefore the assembly includes four such springs.

The head H also includes a propellant inlet valve unit 16, which introduces the propellant through the opening 17 in outer bell 10. A vacuum line 18 communicates with the inside of the inner bell 11 between upper and lower vacuum seals 19*a* and 19*b*. When the ports 20 of the inner bell 11 are brought downwardly into a position between the vacuum seals, a vacuum can be applied through the interior of the inner bell into the space 21 at the lower end of the outer bell. All these details of construction and method of operation are conventional and well-known, and therefore it is believed that it would not be necessary to further describe them herein. (See U.S. Pat. No. 3,157,974).

Figure 2:
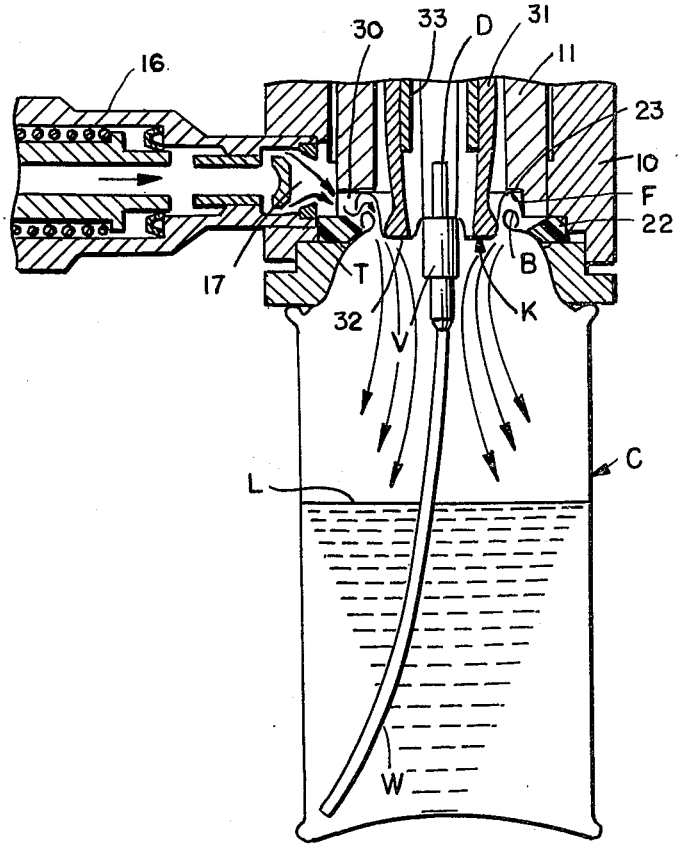
FIG. 2 is an elevational sectional view illustrating the gassing stage of the operation, using the undercap filling machine of FIG. 1, only the lower portion of the filling head being shown.

As shown more clearly in FIG. 2, the outer bell includes a gasket 22 which seals against the domed top T of the container C. The inner bell 11 at its lower end includes a seal or gasket member 23 which seals against the top of the cap unit K, specifically against the top of its outer flange F. The gaskets 22 and 23 are annular in configuration as is the flange F. Flange F is downwardly concave, being shaped and dimensioned so that it is receivable on container bead B and sealingly crimpable thereon.

In FIG. 2, the container C is shown in a position beneath the head H, preparatory to the beginning of the sequence of operations, comprising evacuation, gassing, and crimping. In FIG. 2, the container is shown during propellant charging (gassing).

The cap unit K, as shown more clearly in FIG. 2, includes a centrally disposed dispensing valve assembly V. In FIG. 2, the spray nozzle N, shown in FIG. 1, has been removed. In the preparing of the aerosol packages, it is optional whether the spray nozzles N are on the valve tubes D since they can be applied subsequently. The valve assembly also includes a withdrawal tube W, which extends to the lower portion of the can C. All of these details of construction are well-known, and are part of the standard aerosol container assemblies in commercial use with the undercap filling machines.

Looking again at FIG. 1, it can be seen that the preload springs 14 are held by means of retainer caps 24 and bolts 25 which extend in slidable relation through openings in plate 15, and have threaded lower ends 26 connected to mounting bracket 12. The preload force exerted by springs 14 against plate 15 is transferred to the main cylinder sleeve 27 which slides within a bushing 28. The lower end of cylinder sleeve 27 is threadedly connected to the inner bell 11, as indicated at 29. The preload springs 14 thereby act on the inner bell 11. This action is important in connection with the pressure filling operation shown in FIG. 2.

As shown in FIG. 2, the lower end portion of inner bell 11 is provided with several circumferentially spaced ports 30, which communicate with the inlet opening 17 through which the propellant is admitted under pressure by means of inlet valve 16, a cross-section of which is diagrammatically shown in FIG. 2.

Within the inner bell 11, is a segmented collet 31 which has lower jaw portions 32, and is expandable or contractable by means of the downward or upward movement of the slidable plunger 33. In FIG. 2, the jaws 32 and collet 31 are shown extending within the recessed central portion of cap unit K during the pressure filling operation. The upward movement of the cap unit K is restrained by the engagement of the top of the flange F with the underside of the lower end of outer bell 11, since in this position gasket 23 is bearing against the top of the flange F. After an initial relative movement of about 1/16 inch, the lower ends of the jaws 32 may also contact and restrain the upward movement of the cap unit K. Therefore, further upward movement or lifting of the cap unit K (as will occur due to the pressure exerted by the incoming $CO_2$ gas) will be resisted by the springs 14, which will compress slightly. By the compression of the springs, the plate 15 will be moved upwardly by the same distance as the upward movement or lift of the cap unit K from its starting position. Thus, adjusting the strength of the springs 14 can control and limit the total upward movement of the cap unit K during the gassing operation.

As described in U.S. Pat. No. 3,157,974, the segmented collet 31 may be utilized to lift the cap unit K prior to the start of the pressure filling operation. However, in practice, except for a small initial lift (about 1/16 inches), the cap is lifted upwardly by the gas pressure. This alternative method of operation is described in operating manuals of The Kartridg Pak Company, which corresponds with the description of the alternate operation in column 15 of said U.S. Pat. No. 3,157,974.

In the prior commercial practice using K.P. Undercap Filling Machines, as identified previously herein, and using a pressure liquid fill of fluorocarbon propellant, it has been the practice to employ preload springs, which exert 17.5 pounds of force for each 0.1 inches of compression. In the development of the method of the present invention, it was found that such springs were too weak, and that the method of operation described herein could not be obtained without presetting the crimping head lower than recommended by the manufacturer. It was therefore necessary to approximately double the strength of the preload springs 14. In a specific example using a K.P. Undercap Filler, Model No. 19519, springs exerting 31 pounds of force for each 0.1 inches of deflection were successfully employed. Further, it was determined by actual measurement that the upward movement of plate 15 and the compression of springs 14, being a measure of the lift of the cap unit K, was limited to approximately 0.125 inches from an initial separation of about 0.006 inches, making a total lift of 0.185 inches. The other conditions were a $CO_2$ gas pressure of 680 to 720 psi, a 50% liquid fill with respect to the can volume, and ethanol containing about 4 to 5% water by volume. In general, the preload springs 14 should be selected and/or the head adjusted to limit the lift of the cap units K to the total amounts set out above.

Figure 3A:
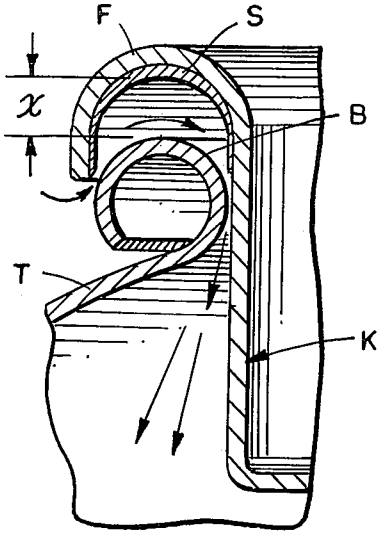
FIG. 3A is a greatly enlarged detail view of the area indicated in FIG. 3.
Figure 3:
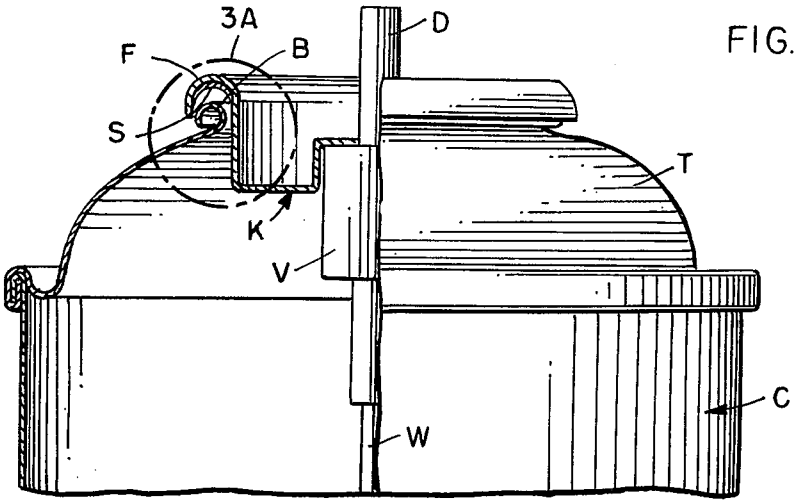
FIG. 3 is an enlarged fragmentary view, partly in section illustrating the general relation of the cap unit to the top of the container at the start of the gassing operation.

The relation of the cap unit K to the top T of the container C can be seen more clearly in FIGS. 3 and 3A, which illustrate the initial separation (about 1/16 inch) just prior to the introduction of the $CO_2$ gas. To facilitate a sealing engagement on crimping, the inner surface of the downwardly concave flange F has a coating of a gasketing material S. When the flange F is engaging and resting loosely on the top of the bead B, as in the crimping step, the gasketing material S will be in contact with the top of bead B. There is usually a slight separation at the start of gassing, and when the $CO_2$ gas is introduced under high pressure, as required for practicing the present method, the cap unit K is blown further upwardly with compression of the preload springs. The underside of flange F, as represented by the inner surface of the gasketing material S, is separated from the top or highest circumferential line of bead B by the distance $x$, as designated in FIG. 3A. It is this distance which is referred to as the lift or total lift.

It will therefore be seen that a close spacing is maintained between the inside of the flange F and the top of the bead B. But this spacing is sufficient to permit the $CO_2$ gas to be charged rapidly into the container. As the gas moves inwardly to the container through the narrow annular opening thus provided, it strikes the liquid within the container (i.e., the liquid L indicated in FIG. 2) with great force. There results a violent turbulent intermixing of the liquid with the incoming gas. The $CO_2$ is thereby dissolved almost instantaneously in the ethanol solution.

Immediately after the injection of the charge of $CO_2$ gas, which is self-mixing and dissolving, as described, the cap K is crimped onto the container top. More specifically, when the propellant inlet valve 16 closes, and due to the rapid drop in pressure within the container C because of the almost instantaneous dissolving of the $CO_2$ gas, the preload springs 14 act on the inner bell 11 to force the cap K downwardly unitl flange F is nearly resting on top of bead B. When this has occurred, the crimping mechanism is actuated. Through hydraulic actuation, the plunger 33 is forced downwardly to expand the collet jaws 32 against the inside of the flange F, forcing the flange into tight sealing engagement with the bead B, and crimping it thereon. The sealing material S is between the metal of the bead B and the metal of the flange F, thereby assuring a gas-tight seal.

The preparation of the liquid compositions, which are filled to the containers before the evacuation, are prepared in the same manner as in prior practice. One or more active ingredients can be incorporated in the ethanol, such as a hair setting resin. In general, the amount of active ingredient in the liquid composition can range from 2 to 10% by weight, based on the total weight of the composition. The active ingredients do not need to be completely soluble in the ethanol or ethanol-water liquid phase, but may be suspended therein in the form of fine particles, providing the liquid composition is sprayable. It will be appreciated that such active ingredients are well-known and are not part of the present invention. What is important for purpose of the invention is that the liquid composition contain a solvent which is essentially ethanol, and that the amount of water in the solvent is limited, as described above, to assure that the $CO_2$ will rapidly dissolve.

Figure 4:
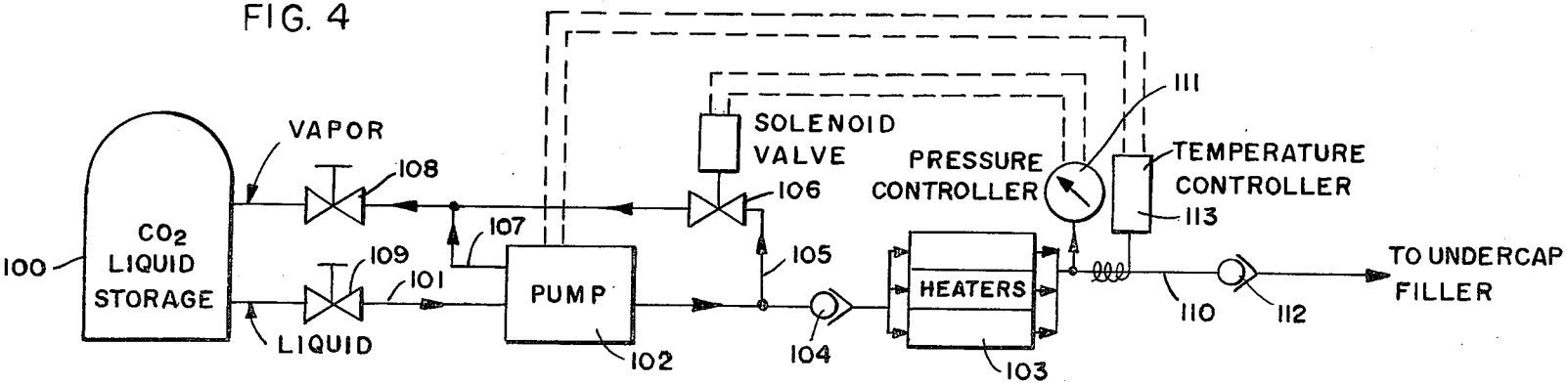
FIG. 4 is a diagrammatic flow sheet illustrating how simply the $CO_2$ gas propellant can be supplied to the undercap filler.

The carbon dioxide gas supplied to the containers in the manner described above can be provided by a very simple system, as illustrated in FIG. 4. It will usually be convenient to maintain the $CO_2$ in liquid condition for storage, such as in the refrigerated storage vessel indicated by the number 100. The liquid $CO_2$ is withdrawn from storage vessel by means of a valve-controlled line 101 and a pump 102. It is passed to a battery of heaters 103 through an inlet check valve 104. Upstream of the valve 104, a return line 105 is provided, the line being controlled by a solenoid valve 106. Downstream of valve 106, a connection is provided for return of vaporized $CO_2$ from pump 102. To shut down the vapor return line, a manual valve 108 may be provided similar to the manual valve 109 on the liquid outlet line 101. The heaters 103 will produce $CO_2$ gas which will be passed to the undercap fillers through a line 110. Line 110 may be provided with a pressure controller or regulator 11 to deliver the gas at a specified pressure to the undercap fillers. An outlet check valve 112 can also be provided to assure control of the pressure, a temperature controller 113 can be included in the system upstream of the valve 112 and adjacent the pressure controller 111.

Basically, therefore, the system consists of liquid storage means for $CO_2$, means for vaporizing a liquid to form gaseous $CO_2$ at a predetermined pressure, and associated control equipment. It will therefore be seen that the supply system is relatively simple and inexpensive.

The method of this invention is generally applicable to and usable with standard commercial size containers. Aerosol containers for use with Undercap Filling Machines have outside diameters in the range of 1 to 3 inches, such as 1.5 inches or 2 11/16. The overall height of the containers are in the range of 2 to 10 inches, such as particularly containers of 3 to 8 inches in height.

We claim:

1. The method of manufacturing an aerosol package for spraying a liquid composition using carbon dioxide ($CO_2$) as the propellant, said package including a container assembly comprising cylindrical container having a top providing an upwardly extending annular bead around a central opening therethrough, and a cap and valve unit mountable on said top, said cap having an annular downwardly concave flange seatable on said bead and adapted to be sealingly crimped thereto, comprising the steps of:

a. partially filling said container with a sprayable liquid composed essentially of ethanol together with not over 15% by volume of water, said liquid filling from 35 to 65% of the internal volume of said container, the rest of said can volume comprising a head space above said liquid composition;

b. evacuating the air from said container head space with said cap unit received on said container top but inseparable therefrom;

c. rapidly charging a metered quantity of $CO_2$ gas into said container at a pressure of from 500 to 800 psig, said gas lifting said cap unit and said gas flowing into said head space between said cap flange and said container bead, the total lift of said cap during said gas charging being limited to not over 0.23 inches, whereby violent turbulent intermixing of said liquid with said $CO_2$ gas occurs so that the $CO_2$ is almost instantaneously dissolved in said liquid; and d. immediately thereafter seating said cap flange on said container bead and sealingly crimping said flange to said bead.

2. The method of claim 1 in which said liquid contains less than 10% by volume of water.

3. The method of claim 1 in which said $CO_2$ gas is charged at a pressure of 550 to 775 psig and the lift of said cap above said can top during said $CO_2$ gas charging is limited to less than 0.21 inches.

4. The method of claim 1 in which said container is filled with an amount of said liquid comprising 40 to 60% of the internal volume of said container.

5. A method of manufacturing an aerosol package for spraying a liquid composition using carbon dioxide ($CO_2$) as the propellant, said package including a container assembly comprising cylindrical container having a top providing an upwardly extending annular bead around a central opening therethrough, and a cap and valve unit mountable on said top, said cap having an annular downwardly concave flange seatable on said bead and adapted to be sealingly crimped thereto, comprising the steps of:

a. partially filling said container with a sprayable liquid composed essentially of ethanol together with up to 10% by volume of water, said liquid filling from 40 to 60% of the internal volume of said container, the rest of said can volume comprising a head space above said liquid;

b. evacuating the air from said container head space with said cap unit received on said container top but separable therefrom;

c. rapidly charging a metered quantity of $CO_2$ gas into said container at a pressure of from 550 to 775 psig, said gas lifting said cap unit and said gas flowing into said head space between said cap flange and said container bead, the total lift of said cap during said $CO_2$ gas charging being limited to not over 0.21 inches, whereby violent turbulent intermixing of said liquid with said gas occurs so that the $CO_2$ is almost instantaneously dissolved in said liquid; and d. immediately thereafter seating said cap flange on said container bead and sealingly crimping said flange to said bead.

6. The method of claim 5 in which said ethanol contains from 2 to 8% water by volume.

7. The method of claim 5 in which said $CO_2$ gas is charged at a pressure of about 700 to 750 psig.

8. The method of claim 5 in which said total lift of said cap above said can top during said $CO_2$ gas charging is in the range of 0.15 to 0.20 inches.

9. The method of manufacturing an aerosol package for spraying a liquid composition using carbon dioxide ($CO_2$) as the propellant, said package including a container assembly comprising cylindrical container having a top providing an upwardly extending annular bead around a central opening therethrough, and a cap and valve unit mountable on said top, said cap having an annular downwardly concave flange seatable on said bead and adapted to be sealingly crimped thereto, comprising the steps of:

a. partially filling said container with a sprayable liquid composed essentially of a mixture of ethanol and water containing from about 2 to 8% water by volume, said liquid filling from 40 to 60% of the internal volume of said container, the rest of said can volume comprising a head space above said liquid composition;

b. evacuating the air from said container head space with said cap unit received on said container top but separable therefrom;

c. rapidly charging a metered quantity of $CO_2$ gas into said container at a pressure of from about 700 to 750 psig, said gas lifting said cap unit above said top and said gas flowing between said cap flange and said container bead into said head space, the total separation of said cap from said container bead during said gas charging being in the range of 0.15 to 0.20 inches, whereby violent turbulent intermixing of said liquid with said gas occurs so that the $CO_2$ is almost instantaneously dissolved in said liquid; and d. immediately thereafter seating said cap flange on said container bead and sealingly crimping said flange to said bead.

10. The method of claim 9 in which said can has an outside diameter in the range from 1 to 3 inches and an overall height in the range from 2 to 10 inches.

* * * * *

UNITED STATES PATENT AND TRADEMARK OFFICE

CERTIFICATE OF CORRECTION

PATENT NO. : 3,977,151

DATED : August 31, 1976

INVENTOR(S) : Richard E. Reever and George F. Dasher

It is certified that error appears in the above–identified patent and that said Letters Patent are hereby corrected as shown below:

In Claim 1 (b), Column 7, line 42, change "inseparable" to -- separable --.

In Claim 5, Column 7, line 63, change "A" to -- The --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*